United States Patent [19]

LiCausi

[11] Patent Number: 4,881,632

[45] Date of Patent: Nov. 21, 1989

[54] MOUNTING DEVICE FOR A COIN CHUTE ASSEMBLY

[75] Inventor: Anthony LiCausi, Middle Village, N.Y.

[73] Assignee: Greenwald Industries Inc., Brooklyn, N.Y.

[21] Appl. No.: 224,738

[22] Filed: Jul. 27, 1988

[51] Int. Cl.[4] ..... G07F 9/00

[52] U.S. Cl. ..... 194/350; 194/344

[58] Field of Search ..... 194/350, 344, 346, 234, 194/235, 238, 291; 232/15, 16

[56] References Cited

U.S. PATENT DOCUMENTS

| | | | |
|---|---|---|---|
| 2,038,330 | 4/1936 | Wilkinson et al. | 194/291 |
| 2,044,843 | 6/1936 | Gorton | 194/291 |
| 3,297,123 | 1/1967 | Hutchins | 194/350 X |
| 3,927,750 | 12/1975 | Greenwald et al. | 194/350 X |

*Primary Examiner*—F. J. Bartuska

*Attorney, Agent, or Firm*—McAulay Fisher Nissen & Goldberg

[57] ABSTRACT

A lockable coin chute assembly is mounted on a housing, and is secured thereto by a locking shaft supported within the housing. The assembly includes a chute flange which abuts against an outer wall of the housing when the assembly is in its mounted position. A separable headed member engages the outer surface of the chute flange, and has a shank portion with passes through aligned openings in the flange and the housing wall. The locking shaft threadedly engages with the headed member for removably securing the coin chute mechanism in its mounted position.

3 Claims, 2 Drawing Sheets

MOUNTING DEVICE FOR A COIN CHUTE ASSEMBLY

BACKGROUND OF THE INVENTION

1. Field of the Invention

This invention relates generally to a lockable coin chute assembly and, more particularly, to an improved locking device for mounting a coin chute mechanism to a housing.

2. Description of the Prior Art

Coin chute mechanisms are used, in combination with switching devices, to initiate the operating cycle of commercial appliances, such as, clothes washers, dryers, vending machines, and the like. The coin chute mechanism typically is mounted on a housing, which in turn, is mounted on the appliance or machine. The switching device is supported within the housing and is actuated by operation of the coin chute mechanism.

In particular, the coin chute mechanism includes a coin slide assembly reciprocally mounted in a guide track for inserted and retracted movement relative to the housing. Inserted movement of the coin slide represents its operate position. The coin slide is formed having one or more coin receiving slots or openings whereby the presence of an appropriately sized coin in the slot(s) is operative to allow inward or inserted movement of the coin slide to its operate position. The inner end of the coin slide is provided with an operator for actuating the switching device upon cyclical movement of the coin slide, thereby closing a circuit to initiate the operating cycle of the appliance or machine.

The housing usually is provided with a locked coin drawer which prevents unauthorized access to a coin receptacle spaced below the coin slide assembly. The arrangement is such that the coin(s) necessary to operate the appliance or machine are carried by the coin slide assembly upon inserted movement of the coin slide to its operate position, whereupon the coin(s) exit the coin chute mechanism and are received in the coin receptacle.

Heretofore, a locking shaft has been proposed for removably securing the coin chute mechanism in its mounted position on the hosing. Typically, the locking shaft is provided with a threaded end, and is supported for rotation within the housing. The threaded end is adapted to threadedly engage with a complementary formed threaded aperture in a flange portion of the coin chute. The arrangement is such that when the coin chute mechanism is in its mounted position, the flange portion thereof is in juxtaposition to an outer wall of the housing having an opening through which passes the forward portion of the coin slide assembly. Another smaller opening or aperture is also formed in the housing wall, which aperture is located in alignment with the threaded aperture in the flange portion of the coin chute in the mounted position thereof. At such time as the coin chute mechanism is mounted on the housing wall, the shaft is manipulated to cause its threaded end to pass through the housing wall aperture and threadedly engages into the flange of the coin chute upon rotation of the shaft. Access to the locking shaft is provided by means of another opening in a sidewall of the housing which is normally closed by a lockable cover plate removably mounted on the housing. An example of such a known locking arrangement is shown in U.S. Pat. No. 3,927,750.

Although the above noted locking arrangement operates satisfactorily, it is subject to tampering by unauthorized individuals for purposes of pilferage. For example, the flange portion of the coin chute typically is made of zinc diecast material which is relatively soft. The shaft, on the other hand, typically is made of steel which is much harder than the zinc diecast flange. Accordingly, if the shaft is inadvertently over-tightened, the threads in the aperture of the zinc diecast chute flange will be stripped rendering the locking arrangement useless. As such, the coin chute may be freely removed from the housing since there is nothing securely locking it in its mounted position.

Further, due to the relative softness of the zinc diecast flange, the locking shaft can be punched inward, into the housing, by striking the outer surface of the flange with a punch tool in the region defining the threaded aperture. This, too, results in a stripping of the flange threaded aperture thereby permitting the coin chute mechanism to be removed from the housing. Removal of the coin chute from the housing often permits access to the money receptacle through the enlarged opening in the outer wall of the housing.

The present invention eliminates the above deficiencies by providing an improved locking arrangement for removably securing the coin chute mechanism to the housing. The improved locking arrangement reduces the likelihood of unauthorized tampering with the interengaging fastening elements of the locking components, or with the coin transfer mechanism of the assembly.

SUMMARY OF THE INVENTION

The lockable coin chute assembly of the present invention includes a housing having an outer wall which is formed having an opening therein. A smaller aperture also is provided in the outer wall of the housing located adjacent to the larger opening.

A coin chute mechanism is mounted on the housing with the coin slide component disposed for inserted and retracted movement into the housing through the outer wall opening thereof. The coin chute includes a flange portion engageable with the outer wall of the housing in the mounted position thereof to cover the larger opening in the housing. The chute flange also includes an aperture which is located to be in alignment with the aperture in the housing outer wall when the coin chute mechanism is in its mounted position on the housing.

A locking shaft is supported within the housing having a forward bearing surface in contact with an inside surface of the housing wall surrounding the aperture in said wall. There also is provided a headed member having an enlarged head portion and a shank portion extending therefrom. The shank portion is configured to extend through the aligned apertures in the chute flange and the housing wall with the head portion bearing against the outer surface of the flange. Interengaging fastening means are provided on the locking shaft and the shank portion of the headed member for removably securing the coin chute mechanism in its mounted position on the housing.

In one embodiment, the shank portion of the headed member is provided with external threads which are threadedly received in a threaded bore formed in the forward end of the shaft. In another embodiment, the end of the shaft is provided with external threads which are threadedly received in a threaded bore formed in the end of the shank portion of the headed member. The shaft and the headed member are each formed of steel to minimize stripping of the interengaging threaded fastening elements, and to thereby reduce the likelihood of unauthorized tampering with such engaged elements.

Additional features and advantages of the present invention will become more apparent from a consideration of the following detailed description when taken in conjunction with the accompanying drawings.

DESCRIPTION OF THE PREFERRED EMBODIMENTS

Figure 1:
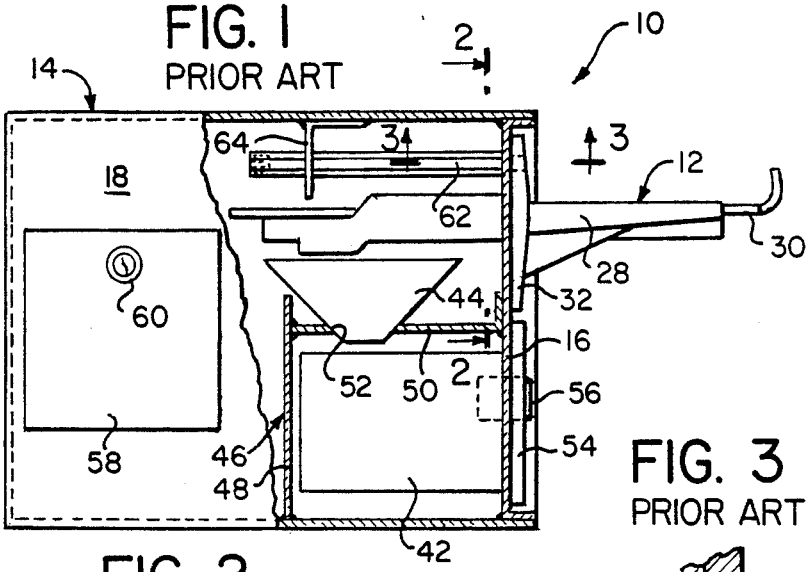
FIG. 1 PRIOR ART
FIG. 1 is a side elevational view, partly in section and with parts broken away, of a lockable coin slide assembly constructed in accordance with the teachings of the prior art.
Figure 3:
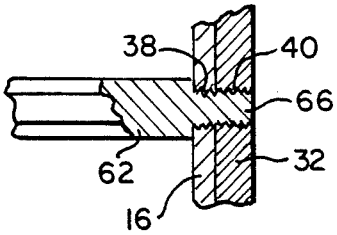
FIG. 3 PRIOR ART
FIG. 3 is a sectional view taken along line 3—3 of FIG. 1.
Figure 2:
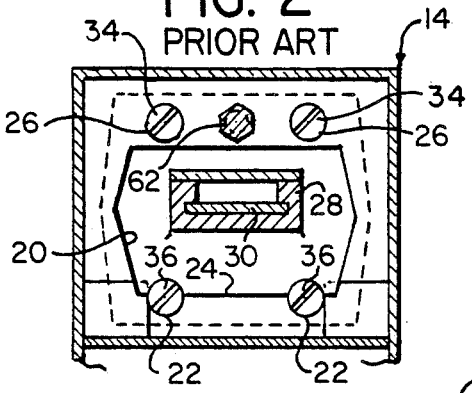
FIG. 2 PRIOR ART
FIG. 2 is a sectional view taken along line 2—2 of FIG. 1.
Figure 4:
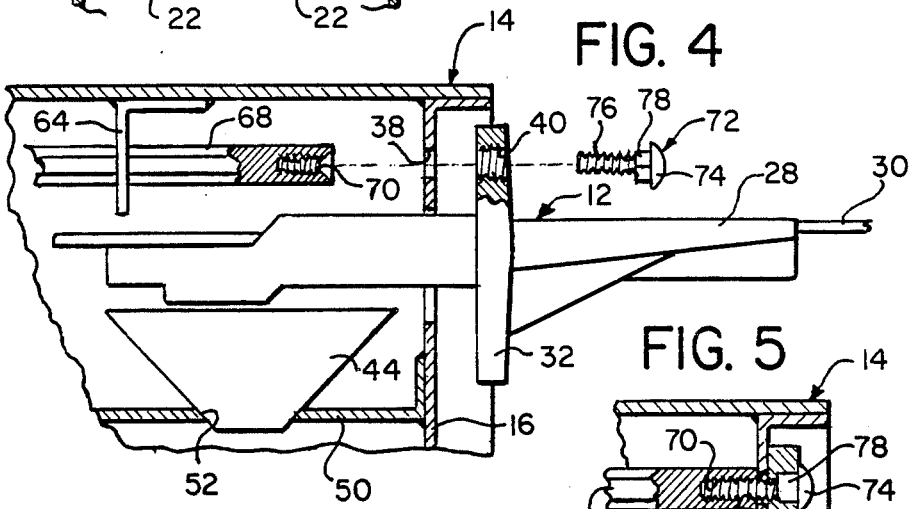
FIG. 4 is a side elevational view, partly in section and with parts broken away, of the lockable coin slide assembly constructed in accordance with the present invention, with the fastening elements disengaged from each other.

Referring to the drawings, numeral 10 represents an apparatus illustrating a lockable coin chute assembly 12 mounted on a housing 14 which is adapted to be installed on a commercial appliance, such as a clothes washer, dryer, vending machine or the like (not shown). Aside from the heretofore known locking arrangement illustrated in FIGS. 1-3, and the structurally distinguishable locking arrangement embodied in FIGS. 4-8 for locking the assembly 12 to housing 14, the remaining structure of the respective apparatuses of FIGS. 1, 4 and 6 are similar and are thus identified by the same reference numerals.

Housing 14 includes front and side walls 16 and 18, respectively. Front wall 16 is formed having an enlarged opening 20 located in an upper surface portion of the wall, with the lower edge of said opening 20 defining a pair of laterally spaced support edge surfaces 22 separated by an edge surface 24 disposed therebetween. Front wall 16 is formed further having a plurality of laterally spaced smaller openings 26 located in a surface portion of wall 16 above opening 20. The said openings 26 and support edge surfaces 22 serve to support and mount assembly 12 relative to housing 14 in the manner hereinafter described.

Assembly 12 includes a guide track 28 reciprocally supporting a coin slide 30 for inserted and retracted movement thereof. Assembly 12 further includes a mounting chute flange 32 which is adapted to be secured to front wall 16 for supporting assembly 12 on the housing. In this regard, as illustrated more fully in FIG. 2, flange 32 is formed having pairs of laterally spaced lugs 34 and 36, respectively, projecting outwardly from the rear surface thereof. The arrangement is such that when assembly 12 is mounted on housing 14, an end portion of guide track 28 passes through front wall opening 20 thereby locating flange 32 in juxtaposition to front wall 16. It will be appreciated that the support edge surfaces 22 and the pair of the front wall openings 26 are suitably sized and located to receive the projecting lugs 34 and 36, respectively, when the guide track 28 is in its fully inserted position. The interengagement of lugs 34 and 36 with the pair of spaced openings 26 and the support edge surfaces 22, respectively, facilitates the mounting of flange 32 to wall 16.

Housing wall 16 further includes another opening or aperture 38 located between the openings 26. Aperture 38 is configured to permit passage of the forward end of a locking shaft as hereinafter described.

Flange 32 further includes a threaded aperture 40 disposed between the spaced lugs 34. At such time as coin chute assembly 12 is in its mounted position on housing 14, threaded aperture 40 is in alignment with housing wall aperture 38 for receiving the locking shaft hereinafter described in connection with the known locking arrangement of FIG. 1.

Coin slide 30 includes a coin receiving portion (not shown) for conventionally transmitting a coin to a coin receptacle 42 positioned within housing 14. The operation is such that the presence of a coin in the coin slide 30 permits the coin slide to be advanced for inserted movement within housing 14 whereby the inner end of slide 30 actuates a switching device (not shown) supported within the housing for actuating the appliance in a conventional manner. Upon inserted movement of coin slide 30, the coin is discharged through an opening in the undersurface of guide track 28 and is directed by a funnel member 44 supported within housing 14 to the coin receptacle 42 located therebelow.

Housing 14 includes partition means represented generally by numeral 46 for enclosing, in part, coin receptacle 42 and for supporting funnel member 44. Partition 46 includes a vertical baffle 48 projecting upwardly from the bottom wall of housing 14, and a horizontal baffle 50 having an upturned end connected to the rear surface of front wall 16. The other end of baffle 50 is connected to vertical baffle 48. Horizontal baffle 50 is formed having an opening 52 through which passes the discharge end of funnel 44. The arrangement is such that coins discharging from coin slide 30 pass through an opening in the undersurface of guide track 28 and fall into the mouth portion of funnel 44, wherein the coins then pass through the discharge end of funnel 44 and fall into the coin receptacle 42.

It will be appreciated that for purposes of security, coin receptacle 42 is enclosed within the area bounded by partition means 46 and the front wall 16 of housing 14. Receptacle 42 is inserted within housing 14 through an opening in the front wall 16 spaced below front wall opening 20. After insertion of receptacle 42, a front cover plate 54 closes the access opening in front wall 16; said cover plate 54 including lock means 56 for locking cover 54 to front wall 16 in conventional manner. Furthermore, in order to service the portions of coin chute assembly 12 projecting internally of housing 14, the side wall 18 of the housing is also formed having an access opening which is normally closed by a cover plate 58 having lock means 60 for locking cover 58 to side wall 18 in conventional manner.

Referring to FIG. 1, there is illustrated the heretofore known arrangement for locking coin chute assembly 12 to housing 14. In this regard, the known locking arrangement includes an elongated bolt or shaft 62 supported within housing 14 by a bracket 64, said shaft having a threaded end 66 which passes through an opening in bracket 64 and is adapted to engage and be received within threaded aperture 40 of flange 32. The locking procedure requires that the maintenance operator first remove cover 58 to gain access to the interior of housing 14 whereupon a special ratchet wrench is necessary to selectively rotate shaft 62 in a given direction for engaging the threaded end thereof within threaded aperture 40 of flange 32. Rotation of shaft 62 in said direction draws flange 32 into tight abutting contact with front wall 16.

At such time as it becomes necessary to remove coin chute assembly 12 from housing 14, the maintenance operator must again first remove cover 58 and use the special tool to rotate shaft 62 in an opposite direction to disengage the threaded end thereof from threaded aperture 40 of flange 32. Thereafter, coin chute assembly 12 may be readily removed from housing 14 for service or replacement with another such assembly.

As previously noted, whereas shaft 62 is made of steel, the chute flange 32 of assembly 12 is made of zinc diecast. Thus, the stripping of threaded aperture 40 either by over-tightening of shaft 62 or by punching the shaft inward of the housing results in having to take the appliance out-of-service until repairs to the assembly have been made.

Figure 5:
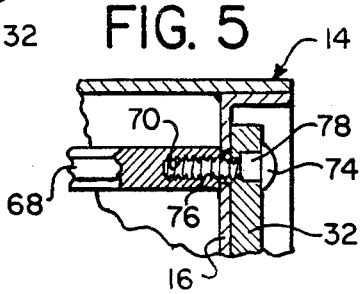
FIG. 5 is a fragmentary view of a portion of FIG. 4 showing the fastening elements interengaged with each other.
Figure 6:
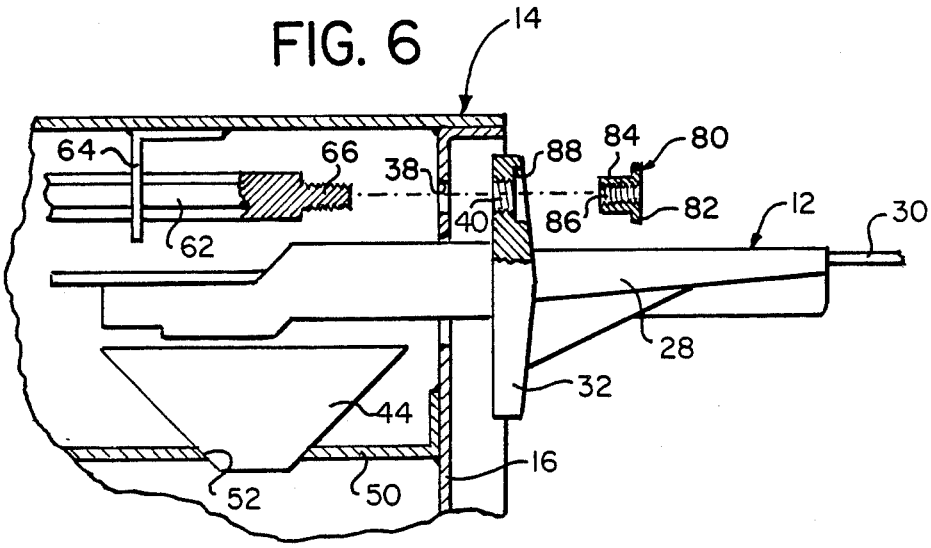
FIG. 6 is a view similar to FIG. 4 showing an alternative embodiment of the fastening elements disengaged from each other.

The present invention provides an improved locking arrangement wherein shaft 62 is replaced with a modified shaft represented by numeral 68 in FIGS. 4 and 5. In place of a threaded end, the forward end of shaft 68 is formed having a threaded bore 70. The transverse dimension of said shaft end is greater than the corresponding dimension of aperture 38 in housing wall 16, and defines a bearing surface which is in contact with, and abuts against, an inside surface of housing wall 16 surrounding the aperture 38 thereof.

There also is provided a headed member represented generally by numeral 72 having an enlarged head portion 74 and a threaded shank portion 76 extending from the head portion. Located intermediate head portion 74 and shank portion 76 is a neck portion 78 having a slight taper which decreases in the direction toward shank portion 76. Headed member 72 typically is known in the industry as a carriage bolt which is made of hardened steel.

Headed member or bolt 72 is positioned to interengage with shaft 68 for removably securing coin chute assembly 12 in its mounted position. As is apparent from FIGS. 4 and 5, the threaded shank portion 76 of bolt 72 passes through the aligned apertures 40 and 38 in the flange 32 and housing wall 16, respectively, and is threadedly received in the threaded bore 70 of shaft 68. The tapered neck portion 78 of bolt 72 has a square cross section and is configured to be frictionally gripped within aperture 40 of flange 32 to prevent rotation of the bolt, and to thereby permit shaft 68 to be threadedly engaged with the bolt.

Head portion 74 is rounded to fit smoothly against the outer surface of flange 32. Thus, it is virtually impossible for a would-be vandal to pry a tool between the abutting surfaces to disengage the elements from each other.

As will be further appreciated, the fact that the interengaging shaft 68 and bolt 72 are both made of steel serves to eliminate the problem heretofore discussed in connection with the stripping of the threaded aperture 40 of flange 32.

Figure 7:
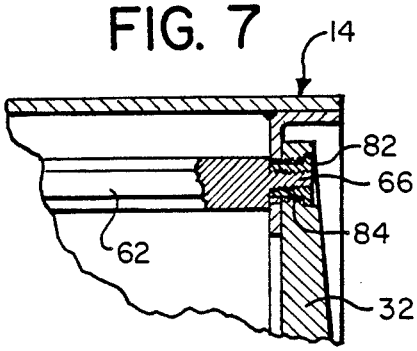
FIG. 7 is a fragmentary view of a portion of FIG. 6 showing the fastening elements of this embodiment interengaged with each other.
Figure 8:
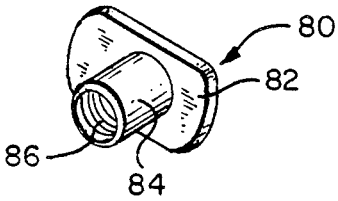
FIG. 8 is a perspective view of a headed member which constitutes one of the fastening elements of the embodiment of FIGS. 6 and 7.

FIGS. 6–8 illustrates another embodiment of the invention in which the bolt 72 is replaced with headed member 80 also made of steel. Headed member 80 is formed having a head portion 82 and a shank portion 84. The end of shank portion 84 defines a threaded bore 86 adapted to receive the threaded end 66 of shaft 62.

In order to facilitate engaging the two elements together, and to reduce the likelihood of vandalism, the outer surface of flange 32 surrounding the aperture 40 thereof is recessed as represented by numerol 88 in FIG. 6. Head portion 82 of headed member 80 is suitably configured to be received in said recessed surface 88 and lie substantially flush with the outer surface of flange 32, as shown in FIG. 7. The configuration of head portion 82 and recessed surface 88 is such that headed member 80 is prevented from rotating when it is fitted within flange 32.

In assembly, the shank portion 84 passes through the aligned apertures 40 and 38 of the flange 32 and housing wall 16, respectively, whereupon the internally threaded shank portion 84 receives the threaded end 66 of shaft 62 upon rotation of said shaft.

While preferred embodiments of the invention have been shown and described in detail, it will be readily understood and appreciated that numerous omissions, changes and additions may be made without departing from the spirit and scope of the claimed invention.

I claim:

1. A lockable coin chute assembly comprising:

a housing including a wall having an opening therein and an aperture located adjacent to said opening;

a coin chute mechanism mounted on said housing, said mechanism including a chute flange engageable with said housing wall in the mounted position thereof and covering said housing wall opening, said chute flange having an aperture therein located in alignment with the aperture in said housing wall when said chute mechanism is in its mounted position on said housing;

a locking shaft supported within said housing, said shaft including a bearing surface having a transverse dimension greater than the corresponding dimension of the aperture in said housing wall, said shaft being positioned with its bearing surface in contact with an inside surface area of said housing wall surrounding the aperture thereof;

a headed member having an enlarged head portion and a shank portion extending from said head portion, said shank portion configured to extend through the aligned apertures in said chute flange and said housing wall with said head portion in contact with and bearing against an outer surface area of said chute flange surrounding the aperture thereof;

said headed member being made of hardened steel and having a portion configured to engage said chute flange to prevent rotation of said headed member relative to said locking shaft; and interengaging fastening means associated with said locking shaft and said shank portion of said headed member for removably securing said coin chute mechanism in its mounted position on said housing.

2. The lockable coin chute assembly of claim 1 wherein said interengaging fastening means comprises external threads on said shank portion of said headed member and a complementary threaded bore in the end of said locking shaft adjacent the bearing surface thereof, and wherein the portion of said headed member engaging said chute flange comprises a neck portion located intermediate said head portion and said shank portion, said neck portion being configured to be received in the aperture in said chute flange to prevent rotation of said headed member relative to said shaft, wherein the threaded bore of said shaft is adapted to threadedly receive the threaded end of said headed member upon rotation of said shaft relative to said headed member.

3. The lockable coin chute assembly of claim 1 wherein said interengaging fastening means comprises external threads on the end of said shaft adjacent the bearing surface thereof and a complementary threaded bore in the end of said shank portion of said headed member, the outer surface of said chute flange surrounding the aperture therein being recessed, and wherein the portion of said headed member engaging said chute flange comprises said head portion which is configured to be received in said recessed surface of said chute flange to prevent rotation of said headed member relative to said shaft, wherein the threaded bore of said headed member is adapted to threadedly receive the threaded end of said shaft upon rotation of said shaft relative to said headed member.

* * * * *